US006168674B1

(12) United States Patent
Gehmecker et al.

(10) Patent No.: US 6,168,674 B1
(45) Date of Patent: Jan. 2, 2001

(54) PROCESS OF PHOSPHATIZING METAL SURFACES

(75) Inventors: Horst Gehmecker, Hofheim; Thomas Kolberg, Heppenheim; Rüdiger Rein, Frankfurt am Main, all of (DE)

(73) Assignee: Dynamit Nobel Aktiengesellscha, Troisdorf (DE)

( * ) Notice: Under 35 U.S.C. 154(b), the term of this patent shall be extended for 0 days.

(21) Appl. No.: 09/468,282

(22) Filed: Dec. 20, 1999

Related U.S. Application Data

(63) Continuation of application No. 09/077,689, filed as application No. PCT/EP96/04767 on Nov. 2, 1996, now abandoned.

(30) Foreign Application Priority Data

Nov. 30, 1995 (DE) ..... 195 44 614

(51) Int. Cl.[7] ..... C23C 22/07
(52) U.S. Cl. ..... 148/259; 148/262; 427/353
(58) Field of Search ..... 148/253, 259, 148/260, 261, 262, 263, 283; 427/353

(56) References Cited

U.S. PATENT DOCUMENTS

| | | |
|---|---|---|
| 2,493,327 | 1/1950 | Vance . |
| 4,838,957 | 6/1989 | Miyamoto et al. . |
| 5,000,799 | 3/1991 | Miyawaki . |
| 5,383,982 | 1/1995 | Hauffe et al. . |

FOREIGN PATENT DOCUMENTS

| | | |
|---|---|---|
| 4241134 | 6/1994 | (DE) . |
| 0361375 | 4/1990 | (EP) . |
| 0414296 | 2/1991 | (EP) . |
| 0653502 | 5/1995 | (EP) . |

*Primary Examiner*—John Sheehan
*Assistant Examiner*—Andrew L. Oltmans
(74) *Attorney, Agent, or Firm*—Fulbright & Jaworski, LLP

(57) ABSTRACT

In a process of phosphatizing metal surfaces, which at least partly consist of iron or steel, in accordance with the low-zinc technology, the metal surfaces are brought in contact with aqueous acid phosphatizing solutions at a temperature of 30 to 65° C. for a period of 1 to 8 min, which solutions contain 0.4 to 2.0 g/l Zn 7 to 25 g/l $P_2O_5$ 0.005 to 0.5 g/l peroxide (calc. as $H_2O_2$)

0.01 to 10 g/l formate (calc. as formate ion), are free from chlorate and added nitrite, and in which the weight ratio of free $P_2O_5$ to total $P_2O_5$ has been adjusted to a value in the range from 0.03 to 0.20, and the content of free acid has been adjusted to a value in the range from 0.5 to 2.5. After contact with the phosphatizing solution, the workpiece is rerinsed with water, which has been adjusted with mineral acid to a pH of from 3.6 to 5.0. The phosphatizing solutions may contain in addition up to 30 g/l nitrate as well as manganese, magnesium, calcium, lithium, tungstate, vanadate, molybdate or combinations thereof, possibly also nickel and/or cobalt, each in an amount of up to 3 g/l, possibly also up to 0.030 g/l copper. The weight ratios Mn:Zn, Mg:Zn, Ca:Zn and possibly (Ni and/or Co):Zn should each be not more than 2:1.

14 Claims, No Drawings

PROCESS OF PHOSPHATIZING METAL SURFACES

This application is a continuation of U.S. application Ser. No. 09/077,689, filed May 29, 1998, now abandoned, which was the National State of International Application PCT/EP96/04767, filed Nov. 2, 1996.

DESCRIPTION

This invention relates to a process of phosphatizing metal surfaes, which at least partly consist of iron and steel, in accordance with the low-zinc technology, and to the use of such process for the preparation of metal surfaces for electro-dipcoating, in particular for cathodic electro-dipcoating.

In the metal-processing industry the process of zinc phosphatizing is used on a large scale. As a pretreatment for lacquer coating, phosphatizing processes making use of the low-zinc technology are particularly advantageous. The phosphatizing solutions used here contain zinc in concentrations of only about 0.4 to 2 g/l and produce phosphate layers on the steel, which have a very good lacquer adhesion and a high resistance to subsurface corrosion of the lacquer.

As accelerators in low-zinc phosphatizing baths nitrite and chlorate as well as organic nitro compounds are particularly suited. These baths provide a high-quality, uniformly covering phosphate layers within a short period. It is also known to use peroxides as accelerators in low-zinc phosphatizing baths. For reasons of work-place hygiene and environmental protection these should be preferred over the use of the aforementioned accelerators, but they have a very high oxidizing effect as regards the oxidation of iron(II) to iron(III). The consequence is that even with a long treatment time comparatively thin phosphate layers with only a moderate protection against corrosion can be achieved.

To solve this problem, the EP-A-414296 proposes a process of phosphatizing iron and steel surfaces in accordance with the low-zinc technology by means of nitrite-free phosphatizing solutions containing zinc, phosphate and nitrate, where the weight ratio of free $P2O_5$ to total $P_2O_5$ has been adjusted to a value in the range from 0.04 to 0.2. $H_2O_2$ or alkali perborate should be added to the phosphatizing solution in such an amount that—in the incorporated condition—the maximum peroxide concentration is 17 mg/l (calc. as $H_2O_2$) and the maximum Fe(II) concentration is 60 mg/l (calc. as Fe).

The aforementioned process can, however, have the disadvantage that the phosphatizing speed is not sufficient for some technical applications. In practice, one therefore tends to increase the phosphatizing speed by adding chlorate. In doing so, a major advantage of the aforementioned process is, however, abandoned. In addition, there are obtained phosphate layers with a relatively low coating weight and a coarse-crystalline structure. Moreover, when zinc is present at the same time, specks are formed on zinc surfaces especially because of the nitrate content. When aluminum is present, crystalline phosphate layers cannot be formed on the aluminum surfaces.

It is the object of the invention to provide a process of phosphatizing metal surfaces at least partly consisting of iron or steel, which process leads to sufficiently thick and fine-crystalline phosphate layers, also leads to proper phosphate layers when zinc and/or aluminum surfaces are present at the same time, and does not have the disadvantage connected with the addition of chlorate.

This object is solved in that in accordance with the invention a process of the above-stated kind is used, where at a temperature of 30 to 65° C. and for a period of 1 to 8 min the metal surfaces are brought in contact with aqueous acid phosphatizing solutions, which contain 0.4 to 2.0 g/l Zn 7 to 25 g/l $P_2O_5$ 0.005 to 0.5 g/l peroxide (calc. as $H_2O_2$)

0.01 to 10 g/l formate (calc. as formate ion), are free from chlorate and added nitrite, and in which the weight ratio of free $P_2O_5$ to total $P_2O_5$ has been adjusted to a value in the range from 0.03 to 0.20, and the content of free acid has been adjusted to a value in the range from 0.5 to 2.5.

Free from added nitrite means that no nitrite should be added to the phosphatizing solutions, but—when designing the process with addition of nitrate—there can at best be present minor contents due to a formation from nitrate.

For determining the free acid, the free $P_2O_5$ and the total $P_2O_5$, reference is made to Rausch, "Die Phosphatierung von Metallen", Leuze-Verlag/Saalgau, 1988, pages 300 to 304.

The process in accordance with the invention is determined in particular for the surface treatment of iron and steel. Together with iron and steel there can, however, also be treated zinc-plated steel, alloy zinc-plated steel, i.e. for instance steel coated with ZnAl, ZnFe and ZnNi, aluminized steel, aluminum, zinc and the alloys thereof.

It is known from WO 94/13856 that for phosphatizing metal surfaces, in particular zinc-plated or alloy zinc-plated steel strips, with treatment times of 2 to 20 sec., phosphatizing baths are used, which in addition to zinc, phosphate and certain contents of free acid and total acid contain water-soluble organic acids with a pK value for the first dissociation constant lying between the dissociation constants of the first and second stage of the phosphoric acid contained in the phosphatizing bath, where as an example for suitable organic acids formic acid is mentioned, and as an example for an additional oxidizing agent hydrogen peroxide or peroxide compounds are mentioned. Apart from the fact that in addition to $H_2O_2$ or peroxide compounds various other oxidizing agents are referred to as suitable, it is emphasized as a particular advantage of the process that it produces bright metallic surfaces in the case of unilaterally zinc-plated substrates. Therefore, it had to be expected that phosphatizing solutions containing peroxide and formic acid and operating in accordance with the low-zinc technology would not be capable of producing proper, high-quality phosphate layers also on surfaces of iron and steel. It could in particular not be expected that the phosphatizing speed is increased considerably by also using formic acid.

The phosphatizing process in accordance with EP-A-361375 also provides for adding formic acid, possibly in combination with nitrate, chlorate, nitrite and nitrobenzene sulfonate to phosphatizing solutions, which preferably operate according to the low-zinc technology. The purpose of adding formic acid is to produce phosphate coatings with relatively high nickel contents when using nickel-containing phosphatizing solutions, even if the nickel concentration in the phosphatizing solution is comparatively low. Even from this prior art it could not be derived that the advantages obtained by means of the inventive process could be achieved.

In accordance with a preferred embodiment of the invention the phosphatizing solutions used in the inventive process may contain nitrate up to a concentration of 30 g/l.

As is usual in processes of the low-zinc technology, the weight ratio of Zn to $P_2O_5$ in the phosphatizing solution preferably is (0.023 to 0.14):1.

When adjusting the kind and quantity of cations and anions of the phosphatizing solutions being used in the inventive process, it is regarded as a rule that for higher bath temperatures and/or zinc concentrations ratios in the upper range, and for lower bath temperatures and/or zinc concentrations ratios in the lower range should be selected.

In accordance with a preferred embodiment of the inventive process the metal surfaces are brought in contact with phosphatizing solutions which contain 0.01 to 0.1 g/l peroxide (calc. as $H_2O_2$) and 0.3 to 2.5 g/l formate (calc. as formate ion).

In accordance with a further advantageous embodiment of the invention the surfaces are brought in contact with phosphatizing solutions containing in addition up to 3 g/l each of manganese, magnesium, calcium, lithium, tungstate, vanadate, molybdate, possibly also nickel and/or cobalt or combinations thereof. From the point of view of work-place hygiene and environmental protection, the addition of nickel and/or cobalt should, however, be omitted. It is also expedient to add up to 0.030 g/l copper to the phosphatizing solutions, where the addition may be effected alone or in combination with the aforementioned cations.

If the phosphatizing solutions additionally contain manganese and/or magnesium and/or calcium, possibly also nickel and/or cobalt, the weight ratio of Mn:Zn, Mg:Zn, and Ca:Zn, possibly (Ni+Co), should not be more than 2:1.

A further advantageous embodiment of the invention consists in the fact that the metal surfaces are brought in contact with phosphatizing solutions which contain fluoborate in an amount up to 3 g/l (calc. as $BF_4$) and/or fluosilicate in an amount up to 3 g/l (calc. as $SiF_6$) and/or simple fluoride in an amount up to 1.5 g/l (calc. as F). The anions fluoborate, fluosilicate and/or fluoride generally increase the phosphatizing speed and are in addition advantageous especially when the treatment of aluminum-containing zinc surfaces is desired. For the crystalline phosphatizing of aluminum and the alloys thereof the presence of free fluoride is absolutely necessary.

The process in accordance with the invention is performed at a temperature in the range from 30 to 65° C. Below 30° C. the phosphatizing speed is generally not sufficient for a modern series production, whereas at higher temperatures disadvantages may appear, for instance due to an increased scaling of the plant.

The process in accordance with the invention may be performed by spraying, dipping, spray-dipping or flow-coating. When the process is used as a spraying method, the zinc concentration should be 0.4 to 1.2 g/l. When the process is applied in a spray-dipping or dipping method, a zinc concentration in the range from 1.0 to 2.0 g/l is advantageous.

It is expedient to introduce the formate ions in the phosphatizing solution as alkali formate, ammonium formate or free formic acid. For adjusting the inventive content of the phosphatizing solution as regards the free acid and the ratio of free $P_2O_5$ to total $P_2O_5$ there are expediently used zinc carbonate, zinc oxide and/or carbonates of the other possibly added cations.

When carrying out the phosphatizing process in accordance with the invention it is expedient to remove water from the phosphatizing solutions, and to compensate the same by adding rinsing water from the succeeding rinsing stage or rinsing stages. The removal of water is effected for instance by evaporation, reverse osmosis and/or electrodialysis. In particular when using hydrogen peroxide as peroxide component it is possible to operate the inventive process such that no sewage contaminated with phosphate is produced in the rinsing process subsequent to the phosphatizing. The rinsing stages expediently designed as rinsing bath cascade employ water containing little or no salt in the last rinsing bath, which water is supplied to the phosphatizing bath opposite to the workpiece flow from rinsing stage to rinsing stage. In the phosphatizing bath it compensates the above-mentioned removal of water from the phosphatizing solution. The water removed from the phosphatizing bath for instance by reverse osmosis and electrodialysis can be recirculated to the rinsing stages.

The pretreatment of the metals before the actual phosphatizing is effected in a conventional way. Degreasing can for instance be effected by means of aqueous, alkaline cleaners, which expediently contain a surfactant. If present, scale or rust should be removed by a pickling treatment, for instance by means of sulfuric acid, phosphoric acid or hydrochloric acid.

Although not absolutely necessary, the workpieces may be prerinsed before the phosphatizing in a manner known per se, so as to form finely crystalline phosphate coatings, for instance by means of an activation bath containing titanium phosphate.

After the phosphatizing treatment the workpieces are usually rinsed with water. To improve the protection against corrosion, the workpieces may subsequently be treated with rerinsing solutions containing for instance chromic acid or no chromic acid. It is, however, particularly advantageous when in accordance with a further advantageous embodiment of the invention a rerinsing with fully deionized water, which by means of mineral acid has been adjusted to a pH in the range from 3.6 to 5.0, is effected instead of the aforementioned rerinsing.

The phosphate coatings produced in accordance with the inventive process can be used in all fields where phosphate coatings are employed. When phosphatizing metal surfaces it is, however, particularly advantageous for the subsequent lacquer coating, in particular the subsequent electro-dipcoating. In this connection, especially the process of preparing for the cathodic electro-dipcoating is of particular importance.

The invention will now be explained by way of example and in detail with reference to the following Examples.

EXAMPLE 1

For use in spraying, the following phosphatizing solutions were prepared:

| Solution A: | |
|---|---|
| 1.0 g/l Zn | 0.7 points free acid |
| 1.0 g/l Mn | 23 points total acid |
| 13.0 g/l $P_2O_5$ | |
| 0.05 g/l $H_2O_2$ | |
| 1.0 g/l formate | |
| 3.0 g/l $NO_3$ | |

Solution B: solution A, but without formate

In solutions A and B steel sheets degreased by means of an activating alkaline cleaner were treated by spraying for 2 min at 52° C. There were measured the coating weight, the crystal size, the minimum phosphatizing time, and—upon coating with a cathodic electrodeposition paint, filler and finishing lacquer—the adhesion and resistance to subsurface corrosion on a subsequently provided scratch. The following values were measured:

| | Solution A | Solution B |
|---|---|---|
| Coating weight | 2,2 g/m$^2$ | 2,2 g/m$^2$ |
| Crystal size | 12 μm | 35 μm |
| Minimum phosphatizing time | 1.2 min | 1.4 min |
| Lacquer adhesion (cross-cut mark) | 0 | 0–1 |
| Subsurface corrosion in an outdoor-weathering test, 12 months (mm) | 1.5 | 1.5 |

EXAMPLE 2

For use in a dipping process, the following compositions were chosen for the phosphatizing solutions.

| Solution C: | |
|---|---|
| 1.8 g/l Zn | 1.6 points free acid |
| 1.0 g/l Mn | 25 points total acid |
| 13.0 g/l $P_2O_5$ | |
| 0.05 g/l $H_2O_2$ | |
| 1.0 g/l formate | |
| 3.0 g/l $NO_3$ | |

alkali for adjusting the free acid

Solution D: like solution C, but with 2.5 g/i $ClO_3$ instead of formate

Solution E: like solution C, but without formate.

Steel sheets degreased by means of an alkaline cleaner were activated in a solution containing colloidal titanium phosphate and phosphatized by dipping into solutions C to E for 3 min at 55° C. The coating weight, crystal size, minimum phosphatizing time and—upon coating with cathodic electrodeposition paint, filler and finishing lacquer—the adhesion and resistance to subsurface corrosion were measured. The following results were obtained.

| | Solution C | Solution D | Solution E |
|---|---|---|---|
| Coating weight (g/m$^2$) | 2.5 | 1.6 | 1.4 |
| Crystal size (μm) | 10 | 22 | 35 |
| Minimum phosphatizing time (min) | 2.0 | 2.0 | 3.0 |
| Adhesion (cross-cut mark) | 0 | 0–1 | 1 |
| Subsurface-corrosion in an outdoor weathering test, 12 months (mm) | 1.5 | 1.5 | 2.2 |

What is claimed is:

1. A process of phosphatizing metal surfaces comprising contacting a metal surface comprising iron or steel with an aqueous acid phosphatizing solution comprising:

0.4 to 2.0 g/l Zn 7 to 25 g/l $P_2O_5$ 0.005 to 0.5 g/l peroxide wherein the peroxide is calculated as $H_2O_2$ 0.01 to 10 g/l formate wherein the formate is calculated as format ion, said phosphatizing solution being free from chlorate and added nitrite, the weight ratio of free $P_2O_5$ to total $P_2O_5$ is from 0.03 to 0.20, and the free acid points have been adjusted to a value in the range from 0.5 to 2.5;

and rerinsing the phosphatized metal surfaces with water which has been adjusted with mineral acid to a pH of from 3.6 to 5.0.

2. The process of claim 1, wherein said phosphatizing solution comprises from 0 to 30 g/l nitrate.

3. The process of claim 1, wherein said phosphatizing solution comprises 0.010 to 0.1 g/l peroxide (calc. as $H2O_7$) and 0.3 to 2.5 g/l formate (calc. as formate ion).

4. The process of claim 1, wherein the phosphatizing solution further comprises from about 0 to about 3 g/l of a member selected from the group consisting of manganese, magnesium, calcium, lithium, tungstate, vanadate, molybdate, nickel and cobalt.

5. The process of claim 4, wherein the phosphatizing solution comprises at least one member selected from the group consisting of manganese, magnesium, calcium, nickel and cobalt and the weight ratio of manganese: zinc, magnesium:zinc, calcium:zinc, nickel:zinc and cobalt:zinc are not greater than 2:1 for each metal present.

6. The process of claim 1, wherein said phosphatizing solution further comprises 0 to 0.030 g/l Cu.

7. The process of claim 1, wherein said phosphatizing solution further comprises a member selected from complex fluorides, simple fluorides and combinations thereof.

8. The process of claim 1, wherein the phosphatized metal surfaces are rerinsed with water which has been adjusted with mineral acid to a pH from 3.6 to 5.0.

9. The process of claim 1, further comprising electro-dipcoating the phosphatized metal surface.

10. The process of claim 9, wherein said electro-dipcoating is cathodic electro-dipcoating.

11. The process of claim 2, wherein said phosphatizing solution further comprises a member selected from the group consisting of complex fluorides, simple fluorides and combinations thereof.

12. The process of claim 3, wherein said phosphatizing solution further comprises at least one member selected from the group consisting of complex fluorides and simple fluorides.

13. The process of claim 4, wherein said phosphatizing solution further comprises a member selected from the group consisting of complex fluorides, simple fluorides and combinations thereof.

14. The process of claim 1, wherein said water is fully deionized water.

* * * * *

UNITED STATES PATENT AND TRADEMARK OFFICE

CERTIFICATE OF CORRECTION

PATENT NO. : 6,168,674 B1
DATED : January 2, 2001
INVENTOR(S) : Gehmecker et al.

It is certified that error appears in the above-identified patent and that said Letters Patent is hereby corrected as shown below:

Column 1,
Line 40, change "$P2O_5$" to -- $P_2O_5$--.

Column 6, claim 3,
Line 17, change "$H2O_7$" to -- $H_2O_2$ --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,168,674 B1
DATED : January 2, 2001
INVENTOR(S) : Gehmacker et al.

It is certified that error appears in the above-identified patent and that said Letters Patent is hereby corrected as shown below:

Title page,
Item [73], Assignee, change "Dynamit Nobel Aktiengesellschaft" to
-- Metallgesellschaft Aktiengesellschaft --.

Signed and Sealed this

Fourth Day of February, 2003

JAMES E. ROGAN
*Director of the United States Patent and Trademark Office*